US007153226B1

(12) United States Patent
Van Der Pols

(10) Patent No.: US 7,153,226 B1
(45) Date of Patent: Dec. 26, 2006

(54) STRING-PULLING DEVICE OF A RACKET STRINGING APPARATUS

(76) Inventor: Erik Bernard Van Der Pols, No. 847 San Feng Road, Feng Yuan, Taichung Hsien (TW)

( * ) Notice: Subject to any disclaimer, the term of this patent is extended or adjusted under 35 U.S.C. 154(b) by 0 days.

(21) Appl. No.: 11/316,705

(22) Filed: Dec. 27, 2005

(51) Int. Cl.
*A63B 51/14* (2006.01)

(52) U.S. Cl. ..... 473/557

(58) Field of Classification Search ..... 473/555–557
See application file for complete search history.

(56) References Cited

U.S. PATENT DOCUMENTS 4,376,535 A * 3/1983 Muselet et al. ..... 473/556
4,417,729 A * 11/1983 Morrone ..... 473/556
5,733,212 A * 3/1998 Wise et al. ..... 473/557
6,162,139 A * 12/2000 Bassili ..... 473/557
6,227,990 B1 * 5/2001 Wise et al. ..... 473/557
6,583,590 B1 * 6/2003 Chu ..... 318/34
2003/0027670 A1 * 2/2003 van der Pols ..... 473/557

* cited by examiner

*Primary Examiner*—Raleigh W. Chiu
(74) *Attorney, Agent, or Firm*—Rosenberg, Klein & Lee

(57) ABSTRACT

A string-pulling device of a racket-stringing apparatus, including a housing, a driving unit, a string-pulling head, a control box and a memory. The driving unit is arranged in the housing. The driving unit includes a collective circuit. The string-pulling head mounted on one side of the housing and rotationally drivable by the driving unit. The control box is detachably mounted on the housing. A main circuit is arranged in the control box for controlling and driving the driving unit. The main circuit is electrically connectable with the collective circuit of the driving unit for controlling and driving the driving unit. A control panel is disposed on the control box. The control panel has several control buttons corresponding to the main circuit for controlling the main circuit.

5 Claims, 5 Drawing Sheets

STRING-PULLING DEVICE OF A RACKET STRINGING APPARATUS

BACKGROUND OF THE INVENTION

The present invention is related to a string-pulling device of a racket-stringing apparatus, and more particularly to a string-pulling device of a racket-stringing apparatus, which can be conveniently maintained and repaired.

FIG. 5 shows a conventional racket-stringing apparatus 7 composed of a bed 71, a racket stringer 8 and a string-pulling device 9. The racket stringer 8 and the string-pulling device 9 are side by side mounted on the bed 71. The racket frame is fixed on the racket stringer 8 for stringing the racket frame. The string-pulling device 9 has a string-pulling head 91 rotationally drivable by a driving unit (not shown) mounted in the string-pulling device 9. A control panel 92 is arranged on outer face of the string-pulling device 9. The control panel 92 via a control circuit is connected with the driving unit for controlling the rotation of the string-pulling head 91.

In use, the racket frame is fixed on the racket stringer 8 for stringing the racket frame. The string passing through the racket frame is chucked in the string-pulling head 91 of the string-pulling device 9. By means of operating the press buttons of the control panel 92, the driving unit is activated to rotate the string-pulling head 91 for adjusting the tension of the string.

The control panel 92 is fixed on the string-pulling device 9 and via wires connected with the control circuit in the string-pulling device 9. Therefore, it is hard to disassemble the control panel 92. As a result, in practice, the racket-stringing apparatus 7 often has some shortcomings as follows:

1. The stringing operation is a long-term work and repeatedly performed. Therefore, the racket-stringing apparatus is easy to wear out. Especially, due to the temperature and humidity of the working site, the parts of the control circuit of the control panel of the string-pulling device tend to damage after a period of use. Once the control circuit of the string-pulling device is damaged, it will be impossible for an operator to string the racket frame. Under such circumstance, it is necessary to repair the control circuit. However, the control circuit is laid in the string-pulling device. Therefore, the entire racket-stringing apparatus must be sent back to the mother factory for service. Alternatively, the mother factory must send a specialist to repair the racket-stringing apparatus. In the case that the racket-stringing apparatus is sent back to the mother factory, the delivery cost will be huge and it is time-consuming and laborious to move the entire racket-stringing apparatus. In the case that the mother factory sends a specialist to repair the racket-stringing apparatus, the cost for the reparation is also enormous.
2. Some data such as rotational speed and tension value are preset in the memory of the control circuit of the string-pulling device for repeated stringing operation. Therefore, it is unnecessary to re-input these data and the string can be pulled under unified tension. In case that the control circuit of the racket stringing apparatus fails, it will be necessary to repair or replace the control circuit. After the control circuit is replaced, the original data of the memory cannot be accessed. Therefore, after repaired, it is necessary to reset the data. This is quite inconvenient and troublesome.

SUMMARY OF THE INVENTION

It is therefore a primary object of the present invention to provide a string-pulling device of a racket-stringing apparatus. In case that the racket-stringing apparatus fails due to damage of the circuit board in the control box, a user can detach the control box from the string-pulling device of the racket-stringing apparatus and directly send the control box to the mother factory for reparation or replacement. This can greatly reduce the maintenance/service cost with respect to both the user and the manufacturer.

It is a further object of the present invention to provide the above string-pulling device of the racket-stringing apparatus, in which the memory is disposed in the driving unit in the housing. When the control box is repaired or renewed, the originally set data such as rotational speed and tension value can be kept in the memory. After repaired, it is unnecessary for the user to reset the data.

According to the above objects, the present invention provides a string-pulling device of a racket-stringing apparatus including a bed, a racket stringer and a string-pulling device, wherein:

the racket stringer and the string-pulling device are mounted on the bed, the racket stringer including a fixing rack for locating a racket frame and a set of string chucks for chucking a string;

the string-pulling device includes a housing, a driving unit, a string-pulling head, a control box and a memory, the driving unit being arranged in the housing, the driving unit including a collective circuit for collecting wires of the driving unit, the housing having a lateral face on which the string-pulling head is mounted, the string-pulling head being rotationally drivable by the driving unit, the control box being detachably mounted on the lateral face of the housing;

a main circuit is arranged in the control box for controlling and driving the driving unit, the main circuit being electrically connectable with the collective circuit of the driving unit for controlling and driving the driving unit, a control panel being disposed on the control box, the control panel having several control buttons corresponding to the main circuit for controlling the main circuit; and the memory is disposed in one of the collective circuit of the driving unit in the housing and the main circuit in the control box for memorizing data such as rotational speed and tension value set with the control box.

The present invention can be best understood through the following description and accompanying drawings wherein:

DETAILED DESCRIPTION OF THE PREFERRED EMBODIMENTS

Figure 1:
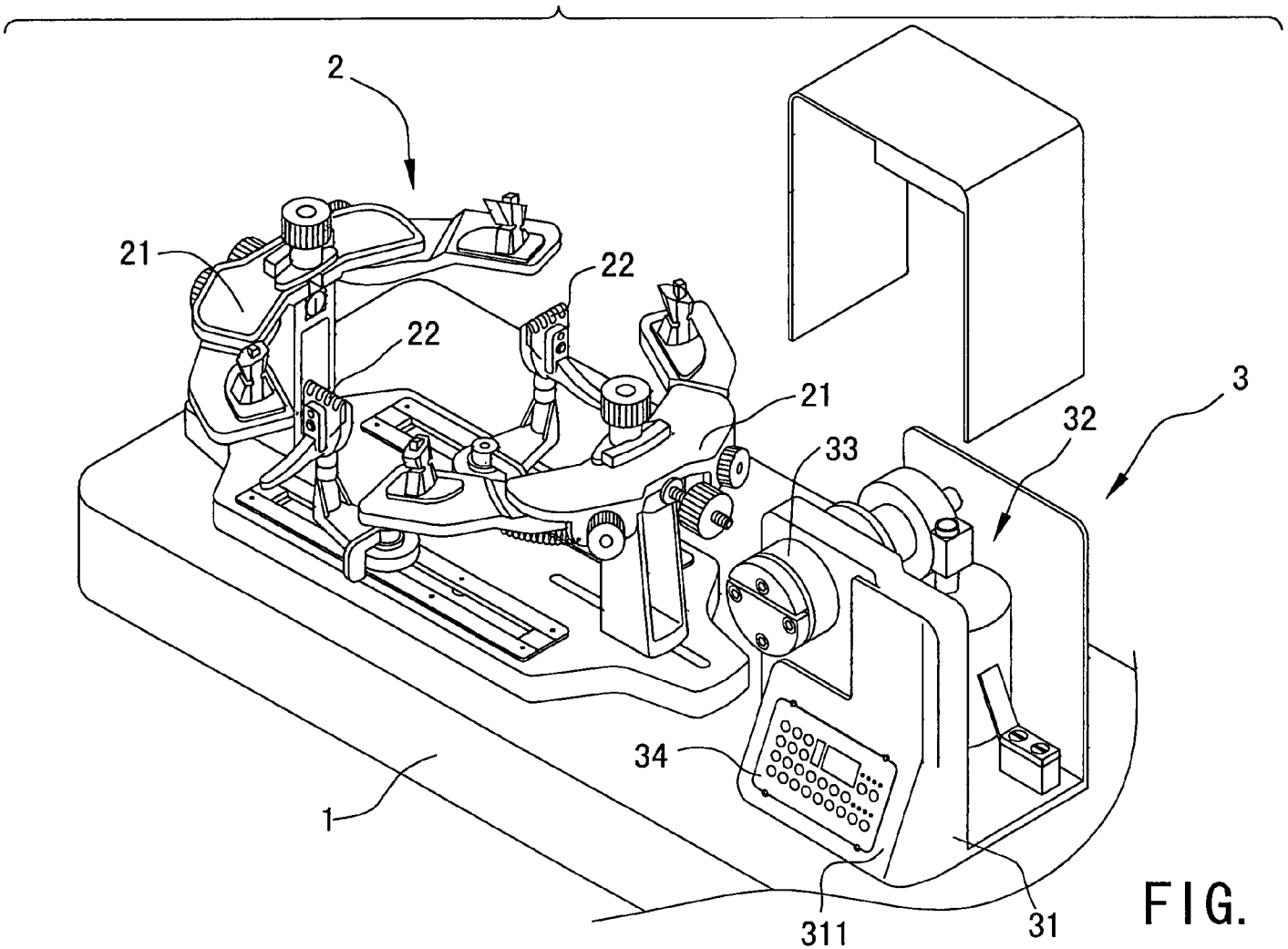
FIG. 1 is a perspective view of the present invention.
Figure 2:
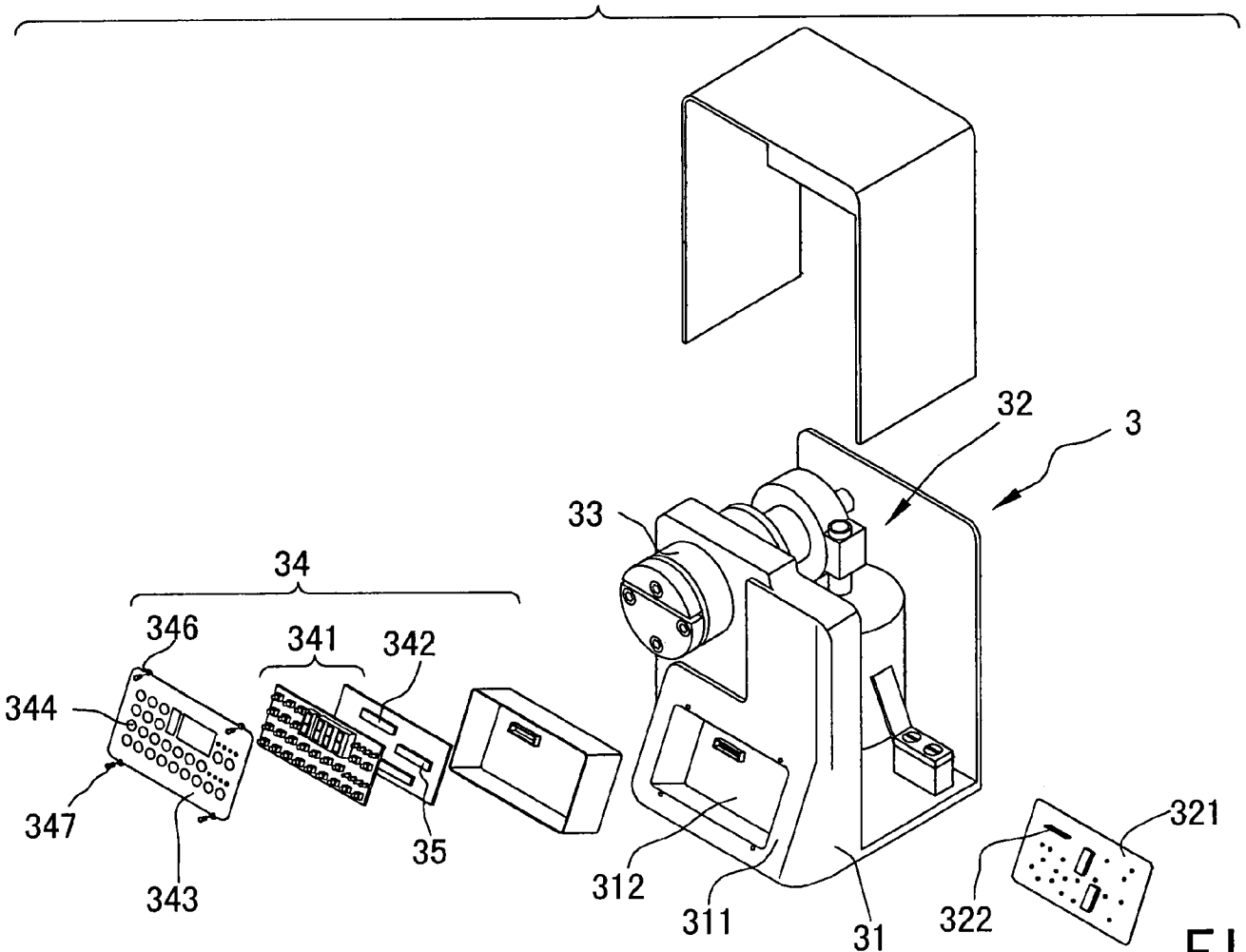
FIG. 2 is a perspective exploded view of the housing and control box of the present invention.
Figure 3:
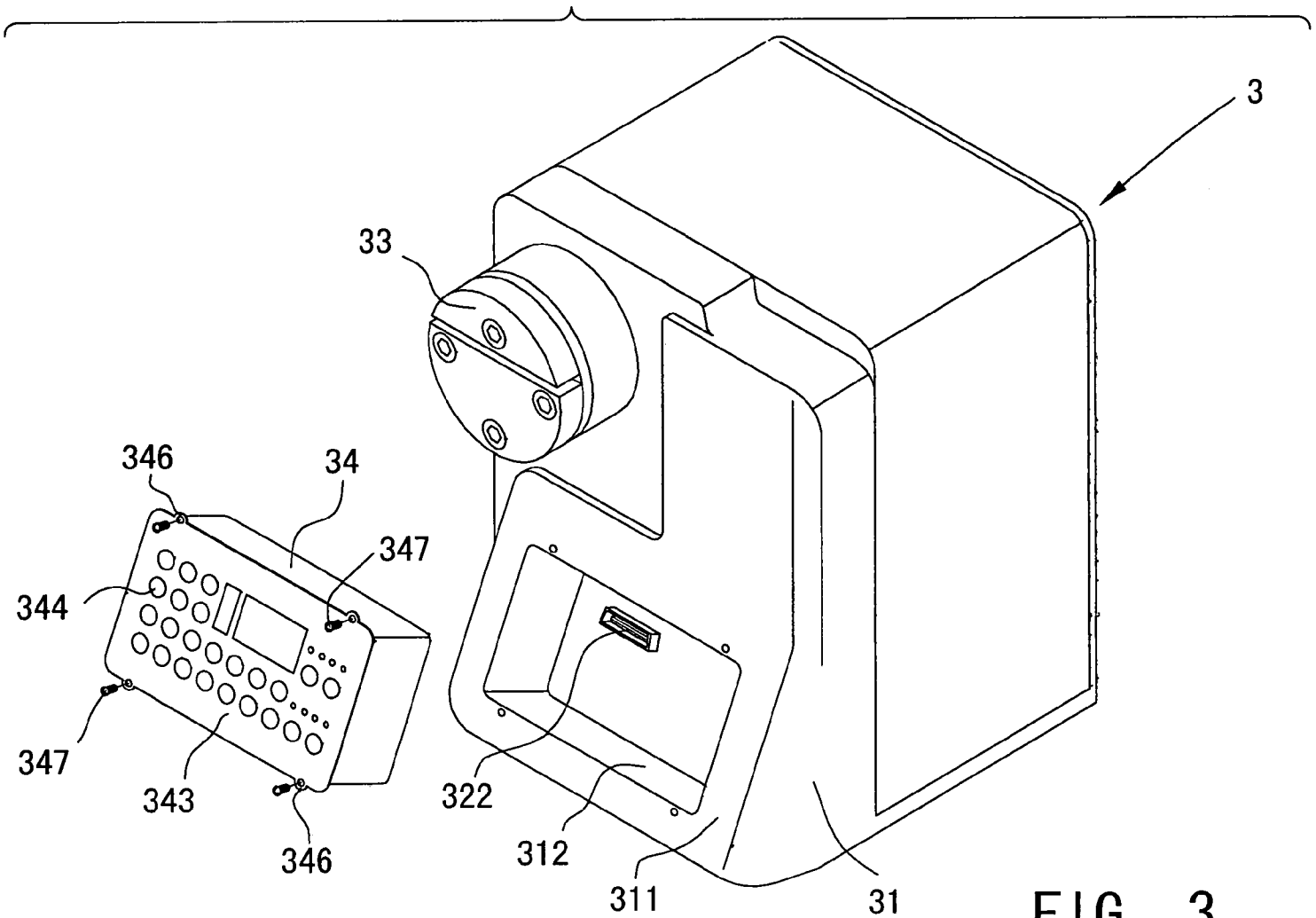
FIG. 3 is a perspective view showing that the control box is detached from the housing of the present invention.

Please refer to FIGS. 1 to 3. The racket stringing apparatus of the present invention includes a bed 1, a racket stringer 2 and a string-pulling device 3.

The racket stringer 2 is mounted on the bed 1. The racket stringer 2 includes a fixing rack 21 for locating the racket frame and a set of string chucks 22 for chucking the string.

The string-pulling device 3 is mounted on the bed 11 near the racket stringer 2. The string-pulling device 3 includes a housing 31, a driving unit 32, a string-pulling head 33, a control box 34 and a memory 35. The driving unit 32 is arranged in the housing 31 for driving the string-pulling head 33. The driving unit 32 includes a collective circuit 321 for collecting the wires of the driving unit 32. The collective circuit 321 includes multiple electronic parts and an input port 322. The housing 31 has a lateral face 311 on which the string-pulling head 33 is mounted. The string-pulling head 33 is rotationally drivable by the driving unit 32. The control box 34 is detachably mounted on the lateral face 311 of the housing 31. The control box 34 is connected with the collective circuit 321 of the driving unit 32. In this embodiment, the lateral face 311 of the housing 31 is formed with a recess 312 in which the control box 34 is mounted. The input port 322 of the collective circuit 321 is positioned on a bottom of the recess 312.

A main circuit 341 is arranged in the control box 34 for controlling and driving the driving unit 32. The main circuit 341 includes multiple electronic parts and an output port 342 for plugging into the input port 322 of the collective circuit 321 of the driving unit 32. Accordingly, the main circuit 341 of the control box 34 is electrically connected with the collective circuit 321 of the driving unit 32 for controlling and driving the driving unit 32. In this embodiment, the memory 35 is disposed in the main circuit 341 for memorizing the data such as rotational speed and tension value set with the control box 34. The output port 342 of the main circuit 341 is positioned in a section of the control box 34 corresponding to the input port 322 of the recess 312 of the housing 31. When the control box 34 is mounted in the recess 312, the output port 342 is plugged into the input port 322.

A control panel 343 is disposed on the control box 34. The control panel 343 has several control buttons 344 corresponding to the main circuit 341 for controlling the main circuit 341.

The control box 34 is mounted in the recess 312 of the housing 31 via a fixing means. In this embodiment, the fixing means includes several lugs 346 formed on the periphery of the control box 32 and screws 347 passing through the lugs. By means of the screws 347, the control box 34 is detachably fixed in the recess 312 of the housing 31.

The main circuit 341 for driving the driving unit 32 is disposed in the control box 34 which is detachably mounted on the housing 31. Therefore, in case that the racket-stringing apparatus fails due to damage of the main circuit 341 in the control box 34, as shown in FIG. 3, a user can unscrew the screws 347 to easily detach the control box 34 from the housing 31. The control box 34 can be directly sent to the mother factory for reparation without sending the bed 1, the racket stringer 2 and the string-pulling device 3 to the mother factory. This can greatly reduce the maintenance/service cost with respect to both the user and the manufacturer.

Moreover, the control box 34 and the main circuit 341 therein can be modularized and mass-produced to lower cost. In case the control box 34 is damaged, the manufacturer can send a new control box 34 to the user for replacement. Therefore, the maintenance/reparation is facilitated. In addition, in the case that the software of the control circuit is upgraded, the manufacturer can send the upgraded control box to the user for replacement.

Figure 4:
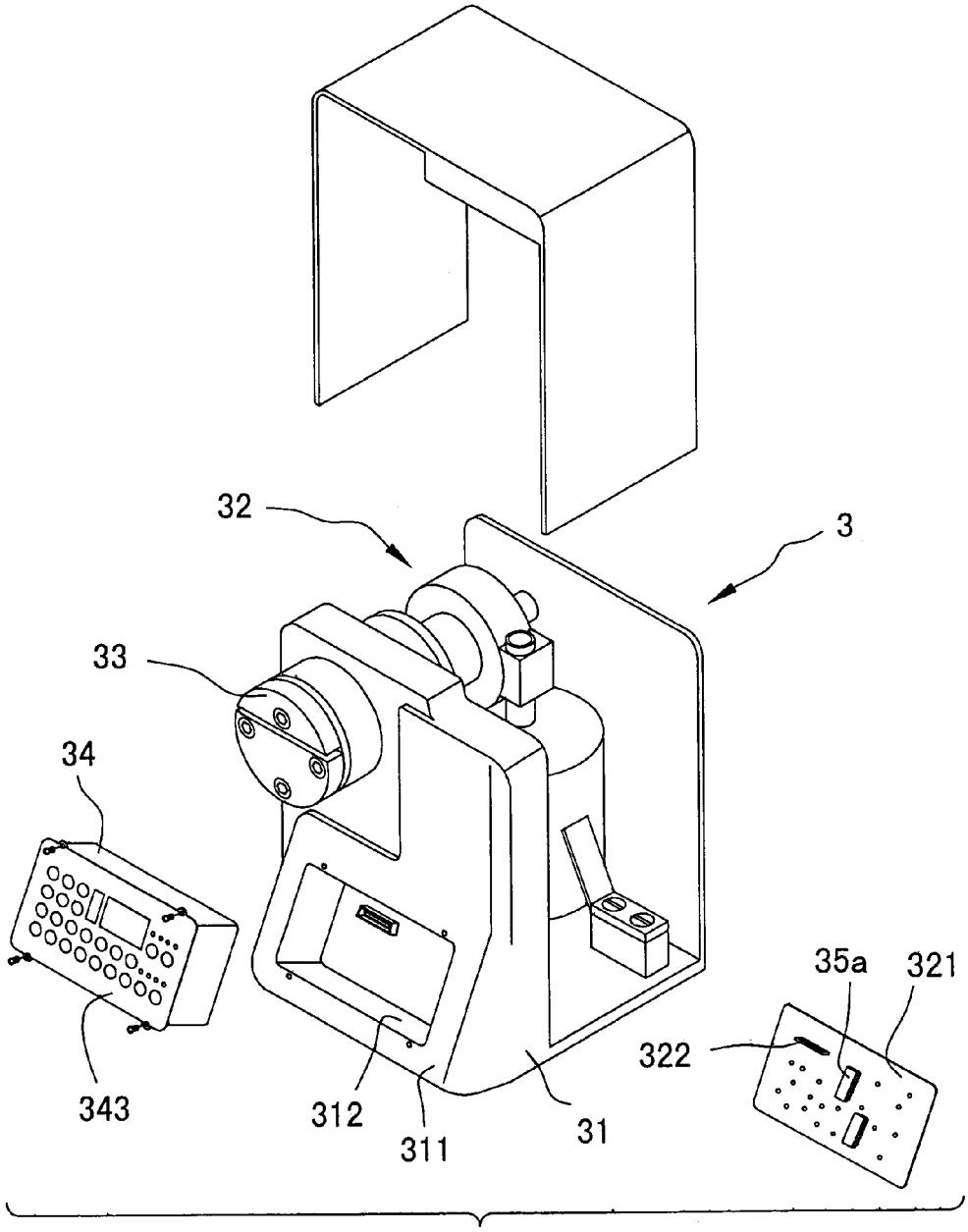
FIG. 4 is a perspective exploded view of the housing and control box of a second embodiment of the present invention.
Figure 5:
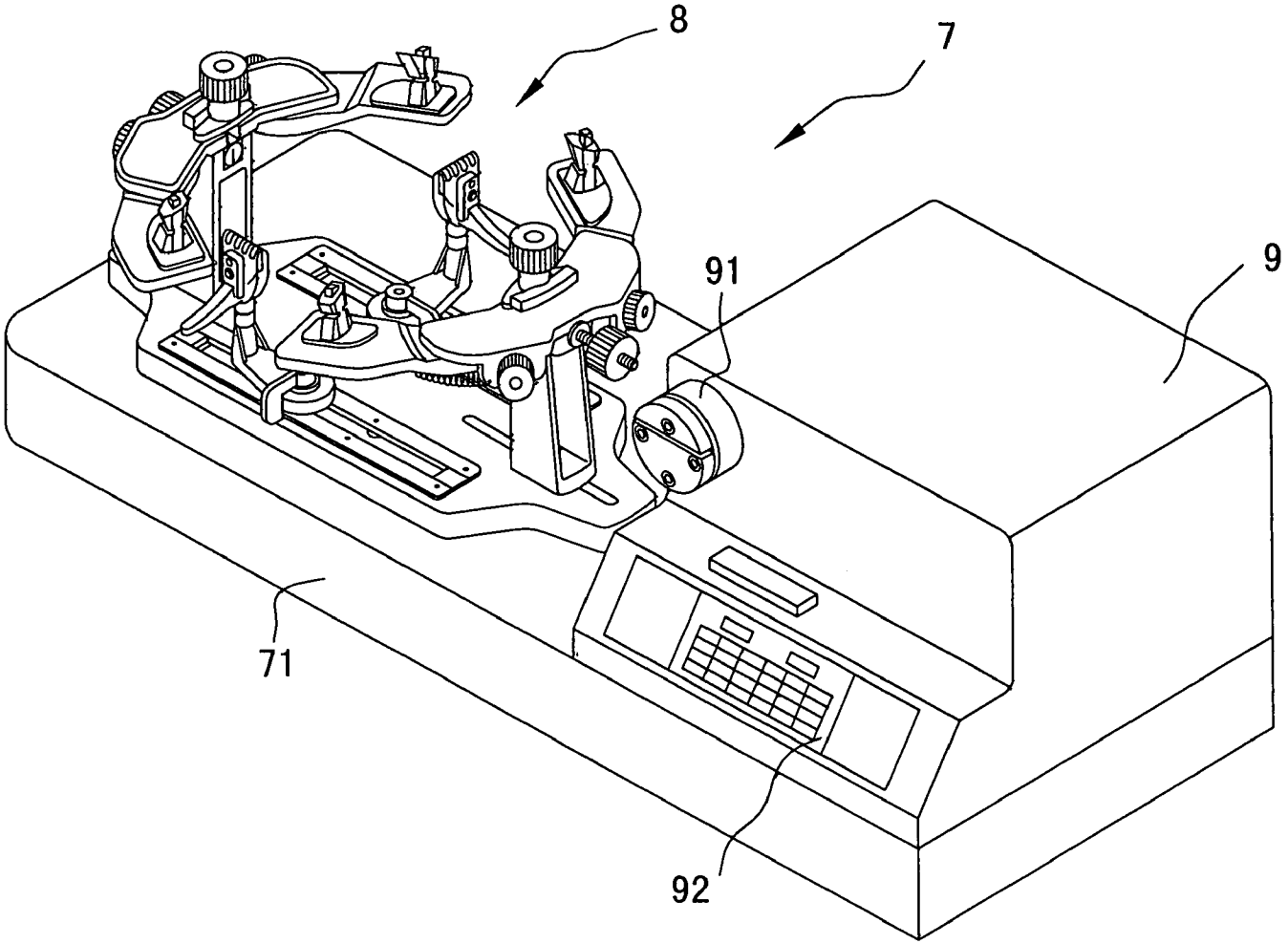
FIG. 5 PRIOR ART
FIG. 5 is a perspective assembled view of a conventional racket-stringing apparatus.

FIG. 4 shows a second embodiment of the present invention, in which the memory 35*a* is disposed in the collective circuit 321 of the driving unit 32 in the housing 32 for memorizing the data such as rotational speed and tension value set with the control box 34.

The memory 35*a* is disposed in the collective circuit 321 of the driving unit 32 in the housing 32. Therefore, when the control box 32 is repaired or replaced, the originally set data such as rotational speed and tension value can be kept in the memory 35*a* disposed in the collective circuit 321 in the housing 32. After repaired, it is unnecessary for the user to reset the data.

The above embodiments are only used to illustrate the present invention, not intended to limit the scope thereof. Many modifications of the above embodiments can be made without departing from the spirit of the present invention.

What is claimed is:

1. A string-pulling device of a racket-stringing apparatus comprising a bed, a racket stringer and the string-pulling device, wherein:

the racket stringer and the string-pulling device are mounted on the bed, the racket stringer including a fixing rack for locating a racket frame and a set of string chucks for chucking a string;

the string-pulling device includes a housing, a driving unit, a string-pulling head, a control box and a memory, the driving unit being arranged in the housing, the driving unit including a collective circuit for collecting wires of the driving unit, the housing having a lateral face on which the string-pulling head is mounted, the string-pulling head being rotationally drivable by the driving unit, the control box being detachably mounted on the lateral face of the housing;

a main circuit is arranged in the control box for controlling and driving the driving unit, the main circuit being electrically connectable with the collective circuit of the driving unit for controlling and driving the driving unit, a control panel being disposed on the control box, the control panel having several control buttons corresponding to the main circuit for controlling the main circuit; and the memory is disposed in one of the collective circuit of the driving unit in the housing and the main circuit in the control box for memorizing data such as rotational speed and tension value set with the control box.

2. The string-pulling device of the racket-stringing apparatus as claimed in claim 1, wherein the lateral face of the housing is formed with a recess in which the control box is mounted, the collective circuit of the driving unit including multiple electronic parts and an input port positioned on a bottom of the recess, the control box being mounted in the recess of the housing via a fixing means, the main circuit of the control box including multiple electronic parts and an output port positioned in a section of the control box corresponding to the input port of the recess of the housing, whereby when the control box is mounted in the recess, the output port is plugged into the input port.

3. The string-pulling device of the racket-stringing apparatus as claimed in claim 2, wherein the fixing means includes several lugs formed on a periphery of the control box and screws respectively passing through the lugs, whereby by means of the screws, the control box is detachably fixable in the recess of the housing.

4. The string-pulling device of the racket-stringing apparatus as claimed in claim 1, wherein the memory is disposed in the main circuit in the control box.

5. The string-pulling device of the racket stringing-apparatus as claimed in claim 1, wherein the memory is disposed in the collective circuit of the driving unit in the housing.

* * * * *